US007767892B2

(12) United States Patent
Osuga

(10) Patent No.: US 7,767,892 B2
(45) Date of Patent: Aug. 3, 2010

(54) KEYBOARD APPARATUS FOR ELECTRONIC MUSICAL INSTRUMENT

(75) Inventor: Ichiro Osuga, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 310 days.

(21) Appl. No.: 12/051,573

(22) Filed: Mar. 19, 2008

(65) Prior Publication Data

US 2008/0236362 A1 Oct. 2, 2008

(51) Int. Cl.
*G10D 13/02* (2006.01)

(52) U.S. Cl. ..... 84/423 R

(58) Field of Classification Search ..... 84/423 R, 84/430–436

See application file for complete search history.

(56) References Cited

U.S. PATENT DOCUMENTS 7,586,030 B2 * 9/2009 Nishida ..... 84/423 R

FOREIGN PATENT DOCUMENTS

JP 06-289851 10/1994
JP 09-198037 7/1997

* cited by examiner

*Primary Examiner*—Kimberly R Lockett
(74) *Attorney, Agent, or Firm*—Morrison & Foerster LLP

(57) ABSTRACT

A keyboard apparatus for an electronic musical instrument, in which hammers each have increased rigidity without being excessively increased in the mass thereof. The hammers are provided to respectively correspond to keys, and each comprised of a resin hammer base and a metal pipe member which has a circular outer cross-sectional shape and has a fixed end thereof formed at its tip with a flat modified cross-sectional portion which closes an opening at the tip of the fixed end. When the hammer base is injection molded, the fixed end of the pipe member is fixed to a pipe-fixing portion of the hammer base by means of outsert molding. The modified cross-sectional portion of the fixed end achieves a whirl-stop function relative to the pipe-fixing portion.

10 Claims, 9 Drawing Sheets

KEYBOARD APPARATUS FOR ELECTRONIC MUSICAL INSTRUMENT

BACKGROUND OF THE INVENTION

1. Field of the Invention

The present invention relates to a keyboard apparatus for an electronic musical instrument including hammers each of which acts to add inertia to a key depressing operation when pivoted by being actuated by a depressed key.

2. Description of the Related Art

Conventionally, there is known a keyboard apparatus for an electronic musical instrument in which each hammer having an appropriate mass is pivoted upon key depression operation, to attain a natural key depression feeling similar to that of an acoustic piano (Japanese Patent Publication No. 3060930).

In this keyboard apparatus, each hammer includes a resin hammer base supported for pivotal motion by a frame and an elongated member of an appropriate mass extending rearwardly therefrom. Upon key depression operation, an actuating portion of the depressed key actuates an actuated portion of the corresponding hammer, whereby the hammer is pivoted in conjunction with the key depression operation, with a free end of the elongated member vertically swung. The elongated member of the hammer is formed by a solid metal rod having a rear half thereof folded back forward, and fixed at its one end to the hammer base, for example, by means of outsert molding. The inertia imparted to the key depression operation is mainly based on the mass of the elongated member.

In a keyboard apparatus of this type, if the elongated member of the hammer is low in rigidity (in particular, low in the second moment of area), undesired vibration is produced when the elongated member is in contact with a stopper for restricting a key depression end position. In that case, an adverse effect can be produced on a feeling at the completion of key depression, or the elongated member can be deformed during a long-term use thereof to vary a key depression stroke. It is therefore preferable that the elongated member be designed to have an increased rigidity as much as possible.

To increase the rigidity of the elongated member, it may be, for example, thickened to increase the sectional area thereof. On the other hand, the mass of the elongated member directly affects the inertia force added to the key, and therefore, increasing the sectional area of the elongated member cannot always be appropriate solution to attain the desired inertia. In other words, there is a restriction in increasing the rigidity of the elongated members, posing a problem.

SUMMARY OF THE INVENTION

The present invention provides a keyboard apparatus for an electronic musical instrument, in which a hammer can have increased rigidity without being excessively increased in the mass thereof.

According to the present invention, there is provided a keyboard apparatus for an electronic musical instrument comprising a frame, at least one key having a hammer-actuating portion and supported for pivotal motion on the frame, and at least one hammer disposed to correspond to the key and having a pivotal fulcrum and an actuated portion, the hammer being supported on the frame such as to be pivoted about the pivotal fulcrum when the actuated portion thereof is actuated by the hammer-actuating portion of the key, the hammer being adapted to impart, when pivoted, inertia to an operation of depressing the key, wherein the hammer includes a hammer base thereof provided with the pivotal fulcrum and the actuated portion, and an extension thereof fabricated separately from the hammer base and provided to extend from the hammer base, the extension being formed by a pipe-like member having one end thereof fixed to the hammer base.

According to the keyboard apparatus of this invention, it is possible to increase the rigidity of the hammer without the need of excessively increasing the mass of the hammer.

In this invention, at least the one end of the pipe-like member of the hammer can be formed to have an outer cross-sectional shape which is not a circular shape.

In this case, the one end of the pipe-like member acts as a whirl-stop relative to the hammer base, whereby the pipe-like member can adequately be fixed to the hammer base with a simple construction.

The pipe-like member can have a modified cross-sectional portion smaller in inner cross-section than a uniform cross-sectional portion of the pipe-like member.

In this case, it is possible to suppress foreign matter from being transported between the inside and outside of the pipe-like member.

A plug for closing an opening in the one end of the pipe-like member can be provided at the one end of the pipe-like member.

With this arrangement, in a case where the hammer base is formed by resin, it is possible to prevent the resin from flowing into the pipe-like member via the open one end thereof.

A plug for closing an opening in another end of the pipe-like member can be provided at the other end of the pipe-like member.

In this case, it is possible to suppress foreign matter from being transported into and out of the pipe-like member via the other end of the pipe-like member.

The plug can be a screw.

In this case, the plug and its peripheral can be made low-priced.

The hammer base can be formed integrally from resin, and the resin can surround an outside of the one end of the pipe-like member and can intrude into inside the pipe-like member through an opening at the one end thereof.

In this case, the one end of the pipe-like member can be rigidly fixed to the hammer base.

A plurality of the hammers can be provided to correspond to respective ones of a plurality of the keys, the pipe-like member of each of the hammers can have, at another end thereof, a mass member fabricated separately from the pipe-like member, and key scaling of a key depression feeling is achieved by making a difference between the plurality of the hammers in at least one of longitudinal position at which the mass member is disposed in the pipe-like member and density, shape, and volume of the mass member.

In this case, key scaling of a key depression feeling can be achieved.

The pipe-like member of the hammer can be formed by a pipe member.

Further features of the present invention will become apparent from the following description of exemplary embodiments with reference to the attached drawings.

DETAILED DESCRIPTION OF THE PREFERRED EMBODIMENTS

The present invention will now be described in detail below with reference to the drawings showing preferred embodiments thereof.

First Embodiment

Figure 1:
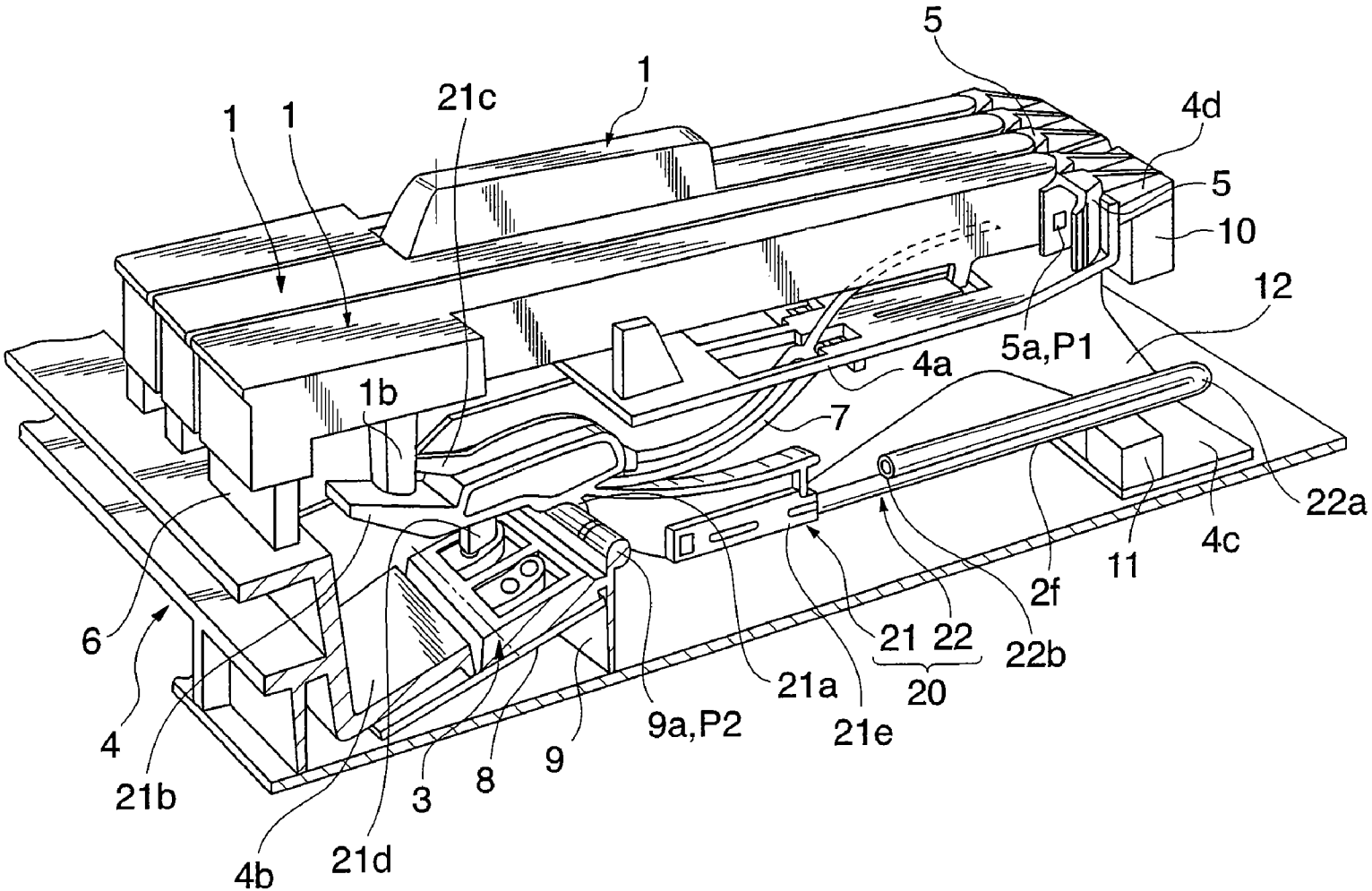
FIG. 1 is a perspective view showing a part of a keyboard apparatus for an electronic musical instrument according to a first embodiment of this invention.

FIG. 1 shows in perspective view a part of a keyboard apparatus for an electronic musical instrument according to a first embodiment of this invention. The keyboard apparatus of this embodiment is mainly comprised of a keyboard chassis 4, keys 1 including white and black keys, hammers 20 adapted to impart appropriate inertia to key depression operation to thereby attain a key depression feeling similar to that of an acoustic piano. The hammers 20 are provided to correspond to respective ones of the keys 1, and arranged in parallel to the direction of arrangement of the keys 1. In FIG. 1, there is shown a non-key-depression state (in which each key 1 is at a position ready for start of a key depression stroke). In 10 the following, that side of this apparatus which faces a performer will be referred to as the front side.

The keys 1 and the hammers 20 are arranged for pivotal motion in a vertical direction about pivotal centers, i.e., a key pivotal axis P1 and a hammer pivotal axis P2, respectively. The keys 1 are each adapted to actuate a corresponding one of the hammers 20, and each hammer 20 is arranged to actuate a switch 3.

A convex spherical key fulcrum portion, not shown, is provided on one side surface of a rear part of each key 1, and the key pivotal axis P1 passes through the center of the key fulcrum portion. On the other hand, a key fulcrum portion 5 is provided rearward of a substantially horizontal chassis portion 4*a* of the keyboard chassis 4. A recess 5*a* is formed in that part of the key fulcrum portion 5 facing the above described key fulcrum portion. The latter key fulcrum portion is in engagement with the recess 5*a* of the key fulcrum portion 5, whereby the key 1 is supported for pivotal motion around the key pivotal axis P1 in the vertical direction.

In the keyboard chassis 4, the horizontal chassis portion 4*a* is coupled for reinforcement to a front part 4*b* of the keyboard chassis 4 by a rib 12. In the front part 4*b* of the keyboard chassis, there are formed key guides 6 each for restricting a front end of the corresponding key 1 from being pivoted in the key arrangement direction (i.e., in the lateral direction of the key 1). The keyboard chassis 4 is provided with a support member 9 having a hammer support 9*a*.

A fork-shaped spring 7 having a bifurcate front end is disposed between vicinity of the hammer support 9*a* and a rear part of the key 1. The spring 7 urges the key 1 toward the key fulcrum portion 5 and urges the hammer 20 toward the hammer support 9*a* of the support member 9, whereby the key 1 and the hammer 20 are prevented from being easily detached from the keyboard chassis 4.

Each of the hammers 20 is comprised of a resin hammer base 21 and a pipe-like member, which is, for example, a metal pipe member 22. A hammer fulcrum 21*a*, a lower extension 21*b*, an upper extension 21*c*, a switch-actuating portion 21*d*, and a pipe-fixing portion 21*e* are formed in the hammer base 21 integrally therewith. The pipe member 22 is extended rearwardly from the pipe-fixing portion 21*e*, and a rear half of the pipe member 22 is folded back forward. The rearmost part of the pipe member 22 is a free end 22*a*. A non-fixed end 22*b* of the pipe member 22, which is opposite from a fixed end 22*c* (described later referring to FIG. 2A) thereof fixed to the pipe-fixing portion 21*e* of the hammer base 21, is located frontward of the free end 22*a* since the rear half of the pipe member 22 is folded back forward at the free end 22*a*.

The hammer base 21 is supported by the hammer fulcrum 21*a* around the hammer support 9*a* of the support member 9 (around the hammer pivotal axis P2), whereby the free end 22*a* of the pipe member 22 can be pivoted in the vertical direction. The switch-actuating portion 21*d* of the hammer 20 is disposed forward of and below the hammer fulcrum 21*a* and adapted to actuate the switch 3 when the hammer 20 is pivoted in the forward direction corresponding to the key depression direction.

The upper and lower extensions 21*c*, 21*b* of the hammer base 21 extend forwardly in the frontmost part of the hammer base 21. A hammer-actuating piece 1*b* extending downward is provided in the front part of the key 1. A buffer material (not shown) made of urethane rubber or the like is attached to a lower end of the hammer-actuating piece 1*b* and inserted between the upper and lower extensions 21*c*, 21*b* of the hammer 20. An operation of depressing/releasing the key 1 is transmitted through the buffer material to the hammer 20, and a returning action of the hammer 20 is transmitted through the buffer material to the key 1. In the key depression stroke and the key releasing stroke, an upper end of the buffer material is always in contact with the upper extension 21*c* of the hammer 20. As a result, it is ensured that the hammer 20 is pivoted in conjunction with the reciprocal pivotal stroke of the corresponding key 1.

Due to the weight of the pipe member 22 constituting a mass portion of the hammer 20 that contains most part of the total mass of the hammer 20, the hammer 20 always urges the key 1 upward via the lower extension 21*b*. A restoration force of a depressed key 1 is not provided by the spring 7 but provided by a self-restoring force of the hammer 20.

An upper stopper 10 is provided in a lower surface of the rear part 4*d* of the keyboard chassis 4, whereas a lower stopper 11 is provided in a chassis support 4*c*. Each of the upper and lower stoppers 10, 11 is made of felt or the like. The upper stopper 10 is adapted to be in contact with the pipe member 22 of the hammer 20 being pivoted in the forward direction in conjunction with a key depression operation to thereby restrict a pivotal motion end position of each of the key 1 and the hammer 20 (specifically, a lower limit position of a front end of the key 1 and an upper limit position of the free end 22*a* of the hammer 20). The lower stopper 11 is adapted to be in contact with the pipe member 22 of the hammer 20 when the key is not depressed, to thereby restrict an upper limit position of the front end of the key 1.

A switch board 8 is mounted on the front part 4*b* of the keyboard chassis, and switches 3 are disposed on the switch board 8. These switches 3 are provided to correspond to respective ones of the switch-actuating portions 21*d* of the hammers 20. Each switch 3 is a two-make touch-response switch of a contact time difference type and adapted to detect the action of the hammer 20 to thereby detect the key 1 being depressed.

Figure 2A:
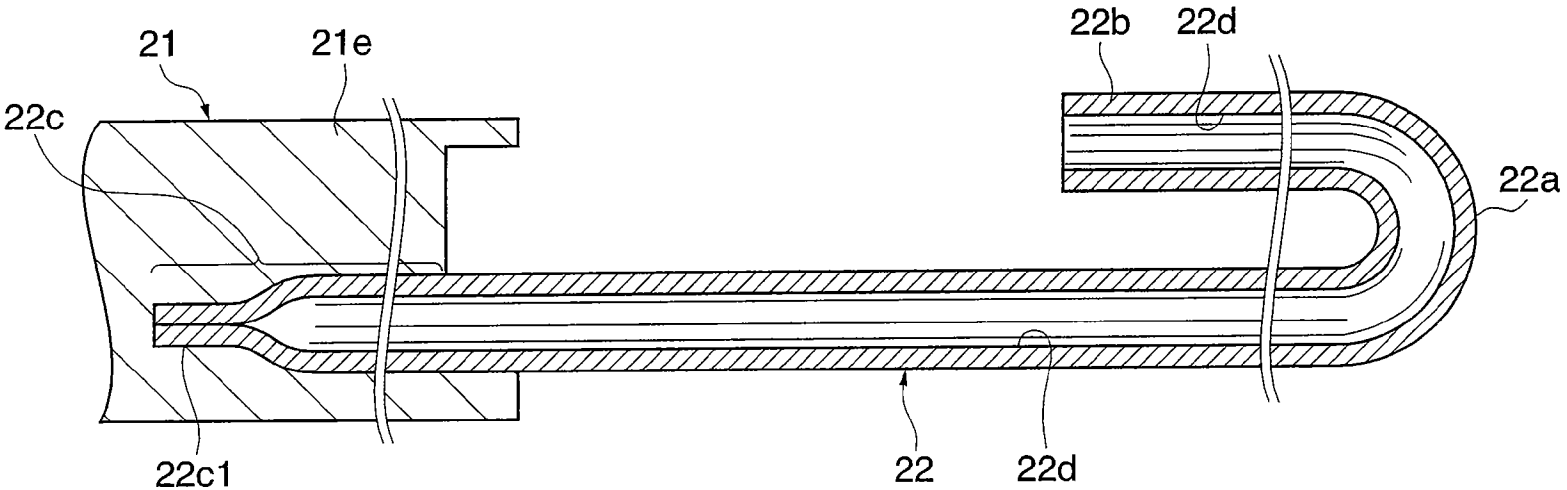
FIG. 2A is a longitudinal section view of a hammer of the first embodiment showing a part of the hammer including from a hammer base to a pipe member.
Figure 2B:
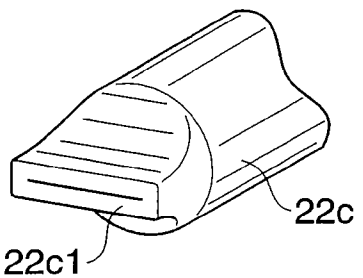
FIG. 2B is a perspective view of a fixed end of the pipe member.

FIG. 2A shows in longitudinal section view a part of the hammer 20 including from the hammer base 21 to the pipe member 22, and FIG. 2B shows in perspective view the fixed end 22*c* of the pipe member 22. When the hammer base 21 of the hammer 20 is injection-molded, the fixed end 22*c* of the pipe member 22 is fixed to the pipe-fixing portion 21*e* of the hammer base 21 by outsert molding.

The pipe member 22 is a uniform tubular member having a hollow 22*d* therein, e.g., a tubular member having a circular outer cross-sectional shape. Specifically, the pipe member 22 is formed by, for example, an extrusion molding method or a drawing molding method into a first type structure having a continuous tubular contour and having a hollow 22*d* therein. Instead of the pipe member 22 (the first type structure), a pipe-like member (second type structure) having a hollow therein may be used, which is formed from a thin sheet metal using a sheet bending method in which the sheet metal is formed into a pipe by joining together left and right edges of the sheet. The second type structure will be described later in a sixth embodiment of this invention.

In the fabrication of the pipe member 22 of the first type structure, a longitudinal end of the pipe member 22 is processed as follows: Prior to the pipe member 22 being fixed to the hammer base 21, a tip of the fixed end 22*c* is formed into a flat modified cross-sectional portion 22*c*1 by cold pressing or the like, in which the fixed end 22*c* is closed. Due to the presence of the modified cross-sectional portion 22*c*1, the fixed end 22*c* fixed to the pipe-fixing portion 21*e* of the hammer base 21 acts as a whirl-stop for the pipe member 20 relative to the pipe-fixing portion 21*e* of the hammer base 21. The modified cross-sectional portion 22*c*1 may be flattened in any direction other than the horizontal direction.

Figure 2C:
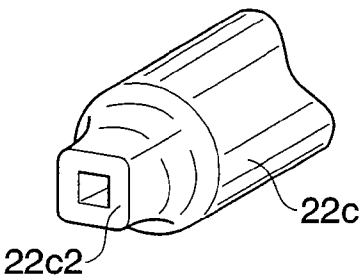
FIG. 2C is a perspective view of a modification of the fixed end of the pipe member.
Figure 2D:
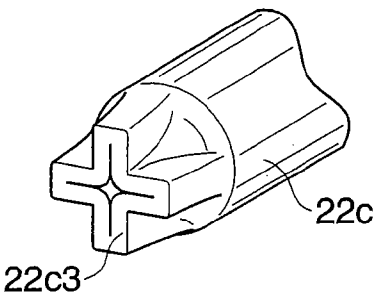
FIG. 2D is a perspective view of another modification of the fixed end.
Figure 2E:
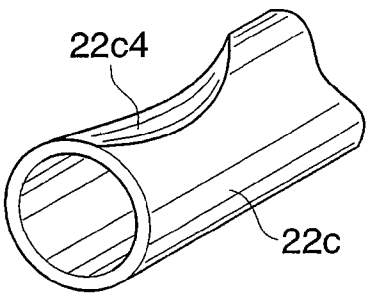
FIG. 2E is a perspective view of a further modification of the fixed end.

The modified cross-sectional shape to achieve the whirl-stop function may be any shape other than a circular shape. For example, as in modifications shown in FIGS. 2C and 2D, the modified cross-sectional portion 22*c*1 may be formed into a rectangular or cruciform shape in cross section. Alternatively, as in a further modification shown in FIG. 2E, it may be formed into a shape in which the fixed end 22*c* is made concaved in a direction perpendicular to the longitudinal direction of the pipe member 22.

With this embodiment, the hammer 20 includes the pipe member 22, which is an extension extending from the hammer base 21 and constitutes the major mass portion of the hammer 20. As compared to a hammer having an extension formed by a solid rod, the hammer 20 can have the increased second moment of area with respect to the neutral axis of cross section, provided that the mass is the same. As a result, the rigidity of the pipe member 22, i.e., the extension, can be increased, while the hammer 20 is able to impart appropriate inertia to a pivotal motion of the corresponding key 1, without being excessively increased in the mass thereof. Accordingly, it is possible to suppress undesired vibration from being produced in the pipe member 22 upon completion of key depression and suppress the pipe member 22 from being deformed (bent) during the long-term use.

Since the modified cross-sectional portion 22*c*1 (or 22*c*2, 22*c*3 or 22*c*4) is formed at the fixed end 22*c* of the pipe member 22, which is fixed to the pipe-fixing portion 21*e* of the hammer base 21, the whirl-stop function for the pipe member 22 relative to the hammer base 21 is achieved by the modified cross-sectional portion 22*c*1, and the pipe member 22 can be adequately fixed to the hammer base 21.

Furthermore, the modified cross-sectional portion 22*c*1 is smaller in inner cross section (the area of the hollow 22*d*) (approximately zero in the example shown in FIG. 2A) than that of the part of the pipe member 22 having a uniform circular cross-section, thereby making it possible to suppress foreign matter such as dirt from being intruded into inside the pipe member 22 via the fixed end 22*c* after the fabrication of the pipe member 22. Moreover, at the time of outsert molding, it is possible to suppress resin constituting the hammer base 21 from being intruded into inside the pipe member 22 via the fixed end 22*c*.

Second Embodiment

Figure 3:
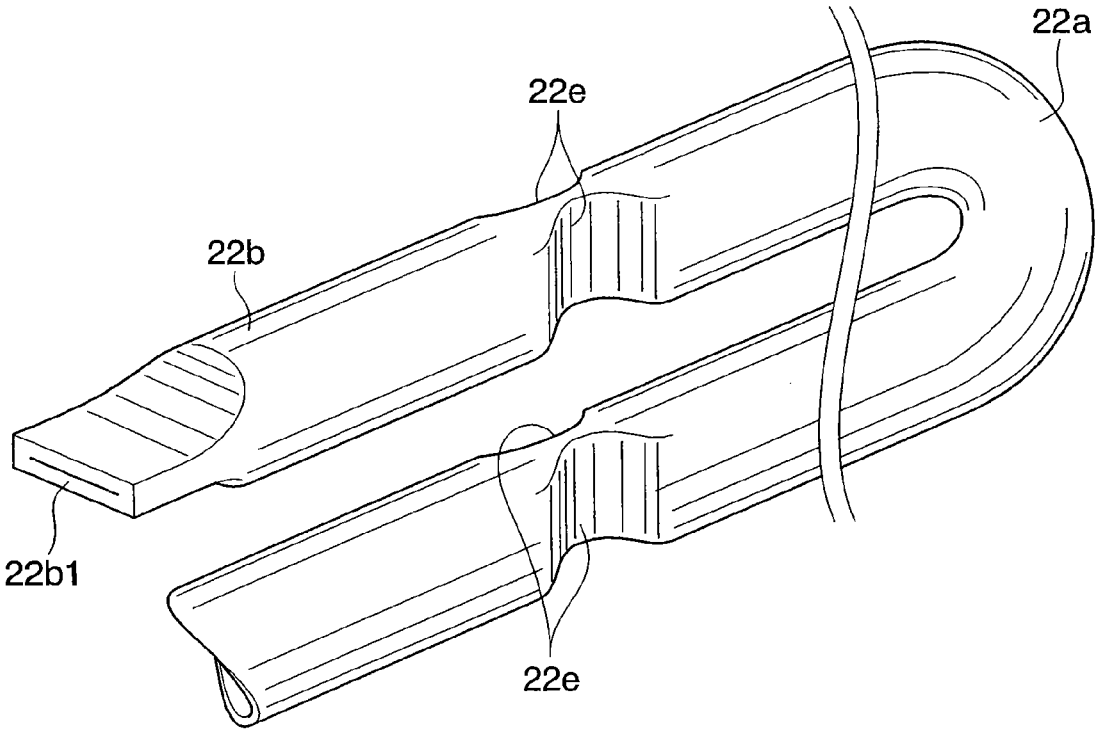
FIG. 3 is a perspective view showing a rear half of a pipe member of a hammer in a keyboard apparatus for an electronic musical instrument according to a second embodiment of this invention.

FIG. 3 shows in perspective view a rear half of a pipe member 22 of a hammer 20 in a keyboard apparatus for an electronic musical instrument according to a second embodiment of this invention. In the second embodiment, only the construction of the pipe member 22 of the hammer 20 is different from the first embodiment, and the other construction is the same as the first embodiment.

In this embodiment, a pair of modified cross-sectional portions 22*e* of a narrow width formed by being pressed in the left and right direction are provided at two places (one of which is shown in FIG. 3) in the middle of the pipe member 22. Each pair of the modified cross-sectional portions 22*e* are formed in upper and lower parts of the pipe member 22, respectively, at the same longitudinal position in the pipe member 22. Since each of the modified cross-sectional portions 22*e* is concaved in the left and right direction, the vertical rigidity of the pipe member 22 is not lowered. Furthermore, the non-fixed end 22*b* has a tip thereof formed into a flat modified cross-sectional portion 22*b*1, which is similar to the modified cross-sectional portion 22*c*1 (see FIGS. 2A and 2B).

According to this embodiment, since the modified cross-sectional portions 22*e*, 22*b*1 are formed, it is possible to suppress foreign matter such as dirt from being intruded from the outside via the non-fixed end 22*b* into the interior of the pipe member 22 and suppress foreign matter such as rust produced inside the pipe member 22 during the long-term use from being discharged via the non-fixed end 22*b* to the outside. From the viewpoint of preventing foreign matter from being transported between the inside and outside of the pipe member 22 after the pipe member 22 is fixed to the hammer base 21, it is sufficient to form the modified cross-sectional portion at one place which is as close to the non-fixed end 22*b* as possible.

With this embodiment, the positions of the modified cross-sectional portions 22*e* in the upper and lower parts of the pipe member 22 are aligned with each other. By aligning theses positions with positions of screws (not shown) for fixing the keyboard chassis 4, for example, to a keybed or a lower case, a space for insertion of a screw driver or other tool is provided around the modified cross-sectional portions 22*e*. Specifically, the screw tightening operation can be carried out, with the hammer 20 kept attached to the chassis, by the screw driver being inserted through the space. Each modified cross-sectional portion 22*e* may not be concaved on both sides but concaved only on one side thereof.

Third Embodiment

Figure 4A:
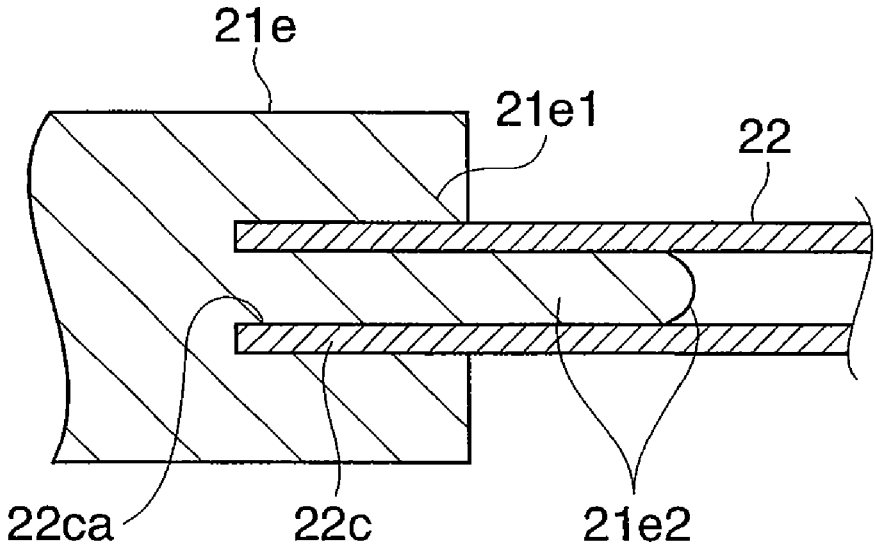
FIG. 4A is a horizontal section view showing a pipe-fixing portion of a hammer base and a fixed end of a pipe member in a keyboard apparatus for an electronic musical instrument according to a third embodiment of this invention.

FIG. 4A shows in a horizontal section view a pipe-fixing portion 21*e* of a hammer base 21 and a fixed end 22*c* of the pipe member 22 in a keyboard apparatus for an electronic musical instrument according to a third embodiment. The third embodiment is different from the first embodiment only in the construction of the fixed end 22*c* of the pipe member 22 and the way of mounting the pipe member 22 to the hammer base 21, but the other construction is the same as the first embodiment.

In this embodiment, the fixed end 22*c* of the pipe member 22 is not closed and has an opening 22*ca* therein. During the hammer base 21 being molded, a portion 21*e*2 of resin for constituting the hammer base 21 flows into inside the fixed end 22*c* of the pipe member 22 via the opening 22*ca*, and an outer periphery of the fixed end 22*c* is surrounded by a portion 21*e*1 of resin for constituting the hammer base 21. By positively introducing the portion 21*e*2 of resin into the interior of the fixed end 22*c* of the pipe member 22, the fixed end 22*c* is held by being sandwiched between the portions 21*e*1, 21*e*2 of resin.

According to this embodiment, since being sandwiched from inside and outside by the resin, the fixed end 22*c* of the pipe member 22 is rigidly fixed to the pipe-fixing portion 21*e* of the hammer base 21.

In this embodiment, the depth of intrusion of the portion 21*e*2 of resin into the interior of the fixed end 22*c* of the pipe member 22 can be controlled by adjusting a pressure at which the resin flows into a die during outsert molding. As a result, hammers for achieving key scaling of a key depression feeling can extremely easily be fabricated. The hammers 20 for achieving the key scaling are different from one another only in the depth of intrusion of resin into the pipe member 22, and therefore, the hammers 20 can be sorted according to weight and can be disposed in the desired places on the keyboard.

Figure 4B:
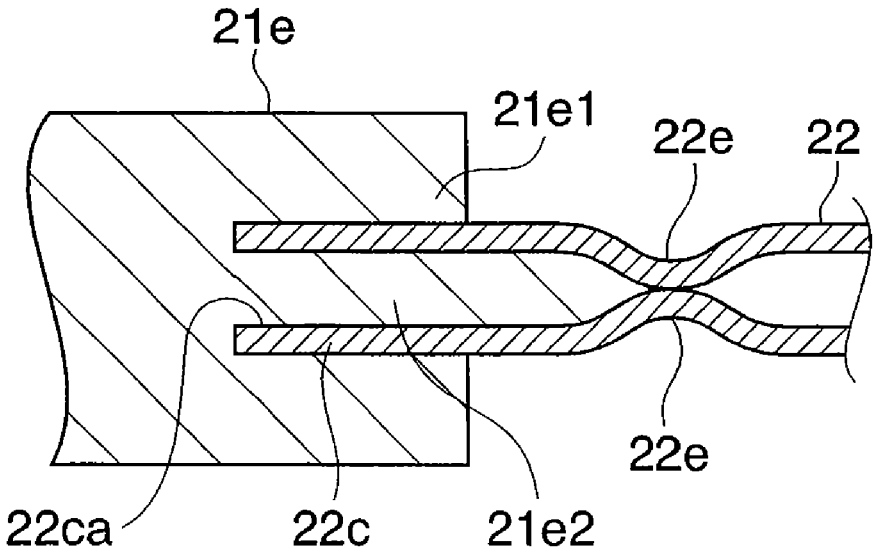
FIG. 4B is a horizontal section view showing a modification of the pipe member of the third embodiment.

FIG. 4B shows in a horizontal section view a modification of the pipe member 22 of the third embodiment. As shown in FIG. 4B, the pipe member 22 has a modified cross-sectional portion 22*e* thereof formed slightly rearward of the fixed end 22*c* of the pipe member 22, the portion 22*e* being similar to or same as the one 22*e* shown in FIG. 3. With this arrangement, further intrusion of the portion 21*e*2 of resin into the pipe member 22 is prevented by the modified cross-sectional portion 22*e*. In other words, the degree (position) of intrusion of the portion 21*e*2 of resin can be regulated according to the position where the modified cross-sectional portion 22*e* is formed. As a result, excessive intrusion of the portion 21*e*2 of resin can be suppressed, which is useful in making the hammer 20 to have the intended entire mass. Also, wasteful use of resin can be prevented.

In this embodiment, it is sufficient for the pipe member 22 to have the open fixed end 22*c* through which resin can flow thereinto, and the fixed end 22*c* is not limited to being a circular shape in cross section. From the viewpoint of ensuring that the fixed end 22*c* of the pipe member 22 has a whirl-stop function relative to the pipe-fixing portion 21*e* of the hammer base 21, the fixed end 22*c* preferably has an opening and a modified cross-sectional portion of an outer cross-sectional shape other than a circular shape.

Fourth Embodiment

Figure 5A:
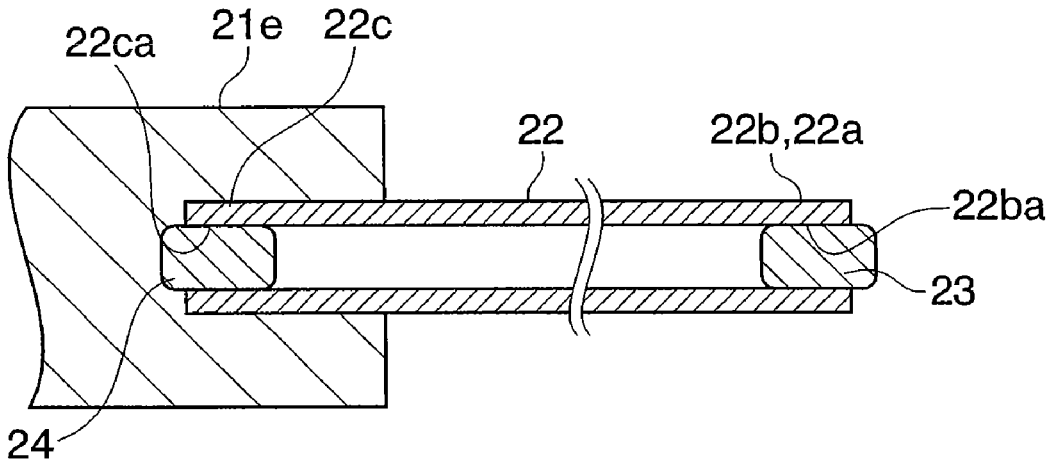
FIG. 5A is a horizontal section view showing a pipe-fixing portion of a hammer base and a pipe member in a keyboard apparatus for an electronic musical instrument according to a fourth embodiment of this invention.

FIG. 5A shows in a horizontal section view a pipe-fixing portion 21*e* of a hammer base 21 and a pipe member 22 in a keyboard apparatus for an electronic musical instrument of a fourth embodiment of this invention. The fourth embodiment is different from the first embodiment only in the construction of the pipe member 22 of the hammer 20, and the other construction is the same as the first embodiment.

As shown in FIG. 5A, the pipe member 22 of this embodiment is comprised of a tube, which is not folded back but simply extends straight and is uniform in cross section. The pipe member 22 has openings 22*ba*, 22*ca* respectively formed at the non-fixed end 22*b* and the fixed end 22*c* thereof. Prior to the pipe member 22 being fixed to the hammer base 21, plugs 23, 24 are inserted and fixed to the openings 22*ba*, 22*ca*, respectively.

The plug 23 is formed by an elastic member such as a rubber material, metal, or the like. The plug 24 is formed by a material, such as metal, which does not melt during the hammer base 21 being molded. The plugs 23, 24 are inserted and fixed by means of press fitting, or engagement and adhesion. During the hammer base 21 being molded, the pipe member 22 is fixed to the pipe-fixing portion 21*e* of the hammer base 21, with the openings 22*ba*, 22*ca* closed by the plugs 23, 24. The plug 23 may be inserted and fixed after completion of molding the hammer base 21.

With the present embodiment, since the openings 22*ba*, 22*ca* of the pipe member 22 are closed by the plugs 23, 24, it is possible to prevent resin for constituting the hammer base 21 from intruding into inside the fixed end 22*c* of the pipe member 22 via the opening 22*ca* and also prevent foreign matter from being intruded into the interior of the pipe member 22 and discharged therefrom via the non-fixed end 22*b* thereof.

With this embodiment, moreover, the non-fixed end 22*b* is a free end 22*a* of the pipe member 22 which is most remote from the hammer fulcrum 21*a* (see FIG. 1), and the plug 23 is provided at the free end 22*a*. Due to the mass of the plug 23, the mass of the pipe member 22 can be concentrated near the free end 22*a*. As a result, high inertia can effectively be attained with ease, and vibration of the pipe member 22 with a pivotal motion of the hammer 20 can rapidly be attenuated whereby undesired sound is suppressed from being produced.

Key scaling of a key depression feeling can be realized by making a difference in the type or the mount position of the plug 23 between a plurality of hammers 20. Specifically, a combination of the density, shape, and volume of the plug 23 and the longitudinal position of the plug 23 in the pipe member 22 is made different between the hammers 20, whereby these hammers 20 have different inertia.

For example, when the type, the disposed position, etc. of the plug 23 are properly set for each of the white and black keys, a proper touch feeling such as a uniform key depression feeling between the white and black keys can be attained. Preferably, the inertia of the hammers 20 should be made smaller for higher tone pitch range. The construction of the plug 23 may be made different between respective ones of the hammers 20 or between hammer groups belonging to different pitch ranges. Since the plug 23 has a function of preventing foreign matter from being intruded into and discharged from the pipe member 22, a complicated construction to achieve such function is unnecessary.

In this embodiment, the plug used for closing an opening of the pipe member 22 may be provided in either the open fixed end 22*c* or the open non-fixed end 22*b* of the pipe member 22. In that case, the modified cross-sectional portion 22*c*1, 22*c*2, 22*c*3, 22*c*4 or 22*b*1 (see FIGS. 2A to 2E and FIG. 3) may be formed at the end of the pipe member 22 in which the plug 23 is not provided.

Figure 5B:
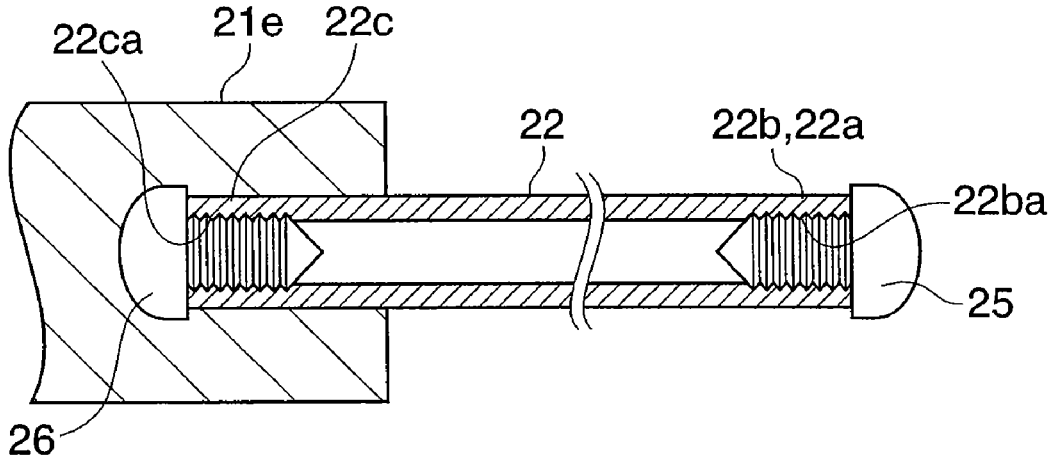
FIG. 5B is a horizontal section view showing a modification of the pipe member of the fourth embodiment.

FIG. 5B shows in a horizontal section view a modification of the pipe member 22 of the fourth embodiment. As shown in FIG. 5B, screws 25, 26 are threadedly attached to the openings 22*ba*, 22*ca* of the pipe member 22, instead of the plugs 23, 24 being inserted. The openings 22*ba*, 22*ca* are formed with threads. Alternatively, the screws 25, 26 may be self-tapped into the openings. Also in this modification, similar effects attained by the example shown in FIG. 5A can be achieved. Furthermore, use of screws can suppress the increase in costs.

Figure 5C:
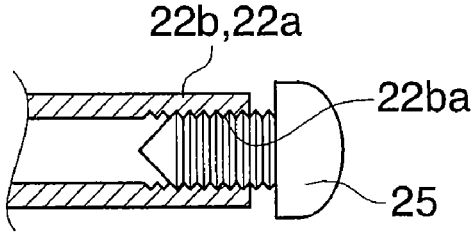
FIG. 5C is a horizontal section view showing another modification of the pipe member.

The key scaling of a key depression feeling can be realized even by using the screw 25. The disposed position of the screw 25 can easily be controlled by changing the depth of the screw 25 being inserted. In an example shown in FIG. 5C, the screw 25 is shallowly inserted as compared to the example shown in FIG. 5B, and the screw 25 is remote in position from the hammer fulcrum 21*a*. Since the moment of inertia is in proportion to the square of a distance from the hammer fulcrum 21*a* to a mass concentration portion, the moment of inertia becomes greater in the example shown in FIG. 5C than in the example shown in FIG. 5B. The inertia of the hammer 20 can be set to the desired value simply by changing the density or volume of the screw 25 or by changing the disposed position of the screw 25 without changing the density or volume thereof. As a result, more sensitive key scaling of a key depression feeling can be realized.

Fifth Embodiment

Figure 6A:
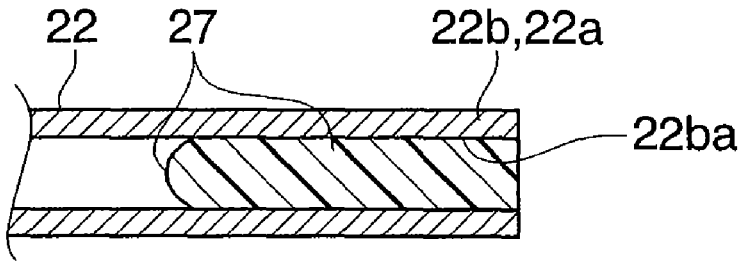
FIG. 6A is a horizontal section view showing a rear part of a pipe member of a hammer in a keyboard apparatus for an electronic musical instrument according to a fifth embodiment of this invention.

FIG. 6A shows in a horizontal section view a rear part of a pipe member 22 of a hammer 20 in a keyboard apparatus for an electronic musical instrument according to a fifth embodiment of this invention. The fifth embodiment differs from the first embodiment only in the construction of the pipe member 22 of the hammer 20 and is the same in other construction as the first embodiment.

As shown in FIG. 6A, in this embodiment, at least rear half of the pipe member 22 is formed by a tubular member which is not folded back, but extends straight and is uniform in cross section as in the fourth embodiment (see FIG. 5A). The pipe member 22 has an opening 22*ba* formed in its non-fixed end 22*b*. The opening 22*ba* is closed by resin 27 filled in the interior of the non-fixed end 22*b*. The resin 27 is filled in the opening 22*ba* of the pipe member 22 by, for example, outsert molding, and a part of the resin 27 projecting outwardly from the pipe member 22 is cut away after being molded. The resin 27 can be filled into the non-fixed end 22*b* of the pipe member 22 at the same time when or separately when the hammer base 21 is molded. The material of the resin 27 may be the same as or different from that of the hammer base 21.

With this embodiment, the resin 27 achieves the same or similar function to that of the plug 23 disposed at the non-fixed end 22*b* of the pipe member 22 in the fourth embodiment (see FIG. 5A). Thus, effects same as or similar to those attained by the fourth embodiment can be achieved, whereby much more mass is concentrated at the free end 22*a* of the pipe member 22 and foreign matter is prevented from being intruded into or discharged from the pipe member 22 via the non-fixed end 22*b*.

Figure 6B:
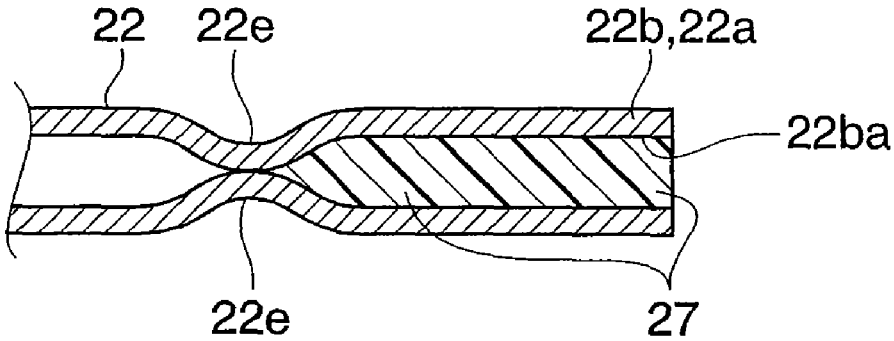
FIG. 6B is a horizontal section view showing a modification of the pipe member of the fifth embodiment.
Figure 6C:
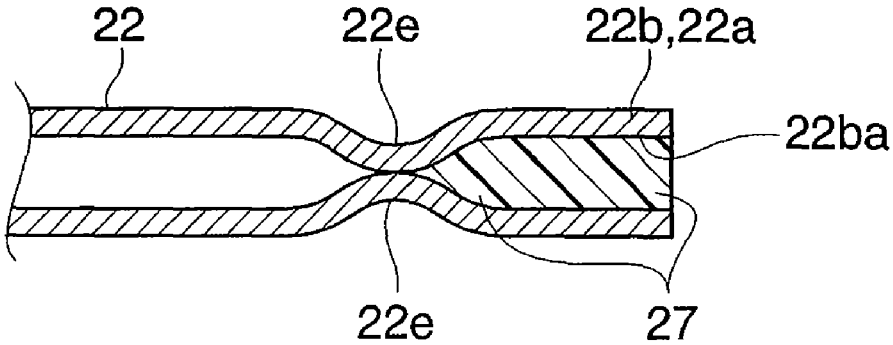
FIG. 6C is a horizontal section view showing another modification of the pipe member.

FIGS. 6B and 6C show in a horizontal section view modifications of the pipe member 22 of the fifth embodiment. As shown in FIGS. 6B and 6C, a modified cross-sectional portion 22*e* similar to that shown in FIG. 3 is formed in the non-fixed end 22*b* of the pipe member 22 at a location slightly toward the pipe-fixing portion 21*e* of the hammer base from the opening 22*ba* of the pipe member. After the formation of the modified cross-sectional portion 22*e*, resin 27 is filled into the non-fixed end 22*b* of the pipe member 22. As a result, the resin 27 is permitted to intrude into the pipe member 22 via the opening 22*ba* only up to the position where the modified cross-sectional portion 22*e* is formed, thereby making it possible to easily control an amount of the resin 27 filled in the pipe member 22 to the desired amount. In the example shown in FIG. 6C, the position of the modified cross-sectional portion 22*e* is closer to the open end of the pipe member 22 and the amount of resin 27 filled in the pipe member 22 is smaller than in the example shown in FIG. 6B.

Also in the modifications shown in FIGS. 6B and 6C, key scaling of a key depression feeling can be realized by making a difference in the amount of resin 27 between respective hammers 20, which corresponds to making a difference in the type of plug 23 or the screw 25 therebetween. To this end, the modified cross-sectional portion 22*e* is formed at a location corresponding to the desired amount of resin 27 for each hammer 20 into which the resin 27 is filled.

In each of the above described embodiments, the pipe member 22 is formed into a shape folded back forward from the rearmost portion of the pipe member 20 (see FIGS. 1 to 3) or a shape extending straight (FIGS. 4A to 6C). However, according to intended effects to be achieved in each embodiment, the shape of the pipe member 22 can be changed from the folded-back shape to the straightened shape or from the straightened shape to the folded-back shape. Furthermore, the pipe member 22 can be formed into a shape other than those shown in the above examples.

Figure 7A:
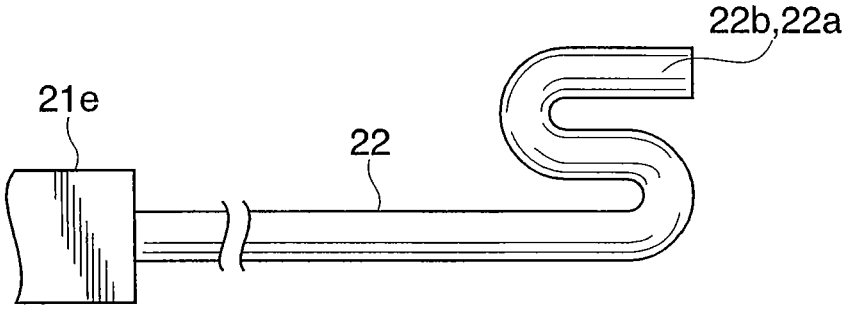
FIG. 7A is a side view showing a modification of the pipe member of the hammer.
Figure 7B:
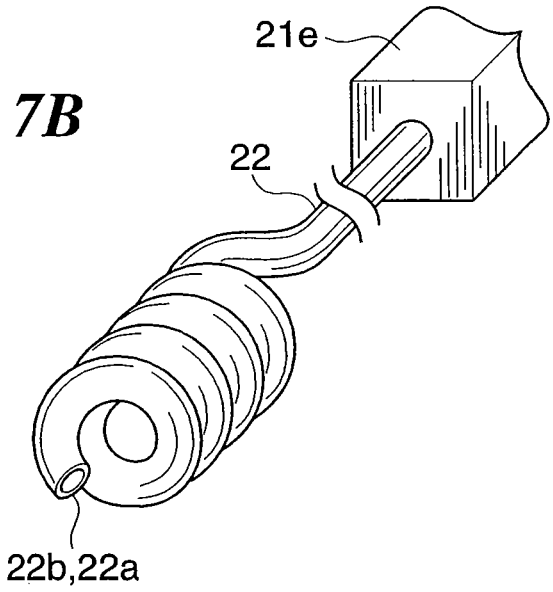
FIG. 7B is a perspective view showing another modification of the pipe member.
Figure 7C:
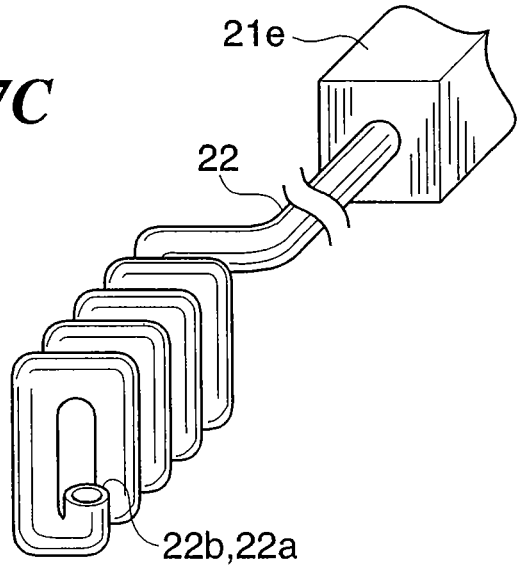
FIG. 7C is a perspective view showing still another modification of the pipe member.

FIGS. 7A to 7C each show in side view or perspective view a modification of the pipe member 22 of the hammer 20. As shown by way of example in FIG. 7A, a rear portion of the pipe member 22 can be folded back forward and then folded back rearward again. This arrangement, in which the pipe member 22 has its non-fixed end 22*b* which is open rearward and constitutes a free end 22*a*, is suitable for being applied to the third to fifth embodiments (FIGS. 4A to 6C) Only from the viewpoint of preventing foreign matter from being intruded into and discharged from the pipe member 22, the longitudinal position and the direction of the non-fixed end 22*b* are not limited.

By forming a rear half of the pipe member 22 into a folded shape, the major mass of the pipe member 22 is concentrated at the rear of the pipe member 22, which is advantageous in that increased inertia can be attained while making the hammer 20 compact in the entire length. Such effect can be enhanced, in particular, by using the pipe member 22 having the rear thereof folded back a plurality of times as shown by way of example in FIG. 7A. For that purpose, the pipe member 22 may be folded a greater number of times than in the example shown in FIG. 7A.

To concentrate the major mass of the pipe member 22 at its rear without increasing the entire length of the hammer 20, that part of the rear half of the pipe member 22 which is on the side close to the non-fixed end 22*b* may be formed into a spiral shape, which is circular or rectangular as seen from rear, as shown in FIGS. 7B and 7C.

Figure 8A:
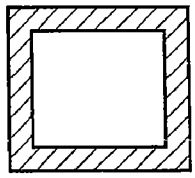
FIG. 8A is a section view showing a modification of the pipe member which is non-circular in outer cross-sectional shape.
Figure 8B:
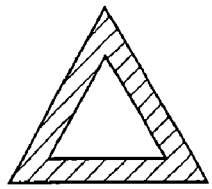
FIG. 8B is a section view showing another modification of the pipe member of a non-circular cross section.
Figure 8C:
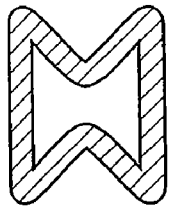
FIG. 8C is a section view showing still another modification of the pipe member of a non-circular cross section.

In each of the above described embodiments, that part of the pipe member 22 which is uniform in cross sectional shape, other than the modified cross-sectional portion of the pipe member 22, is formed into a circular outer cross-sectional shape, but this is not limitative. For example, as shown in FIGS. 8A to 8C, the pipe member 22 may be formed into a rectangular, triangular, or butterfly shape. In other words, the pipe member 22 may be formed into any shape into which a pipe can be formed and in which the second moment of area with respect to the neutral axis of cross section becomes greater than that in a solid rod of the same cross section area. The pipe member 22 may be formed into a shape closer to an H-shape than to the shape in the example shown in FIG. 8C.

In the case of using the pipe member 22 having an outer cross-sectional shape, which is not circular as shown by way of example in FIGS. 8A to 8*c*, over the entire length thereof, it is unnecessary to form the fixed end 22*c* into the modified cross-sectional portion 22*c*1 (see FIG. 2A). A whirl-stop function relative to the pipe-fixing portion 21*e* of the hammer base 21 can be achieved by the non-circular pipe member 22.

Figure 8D:
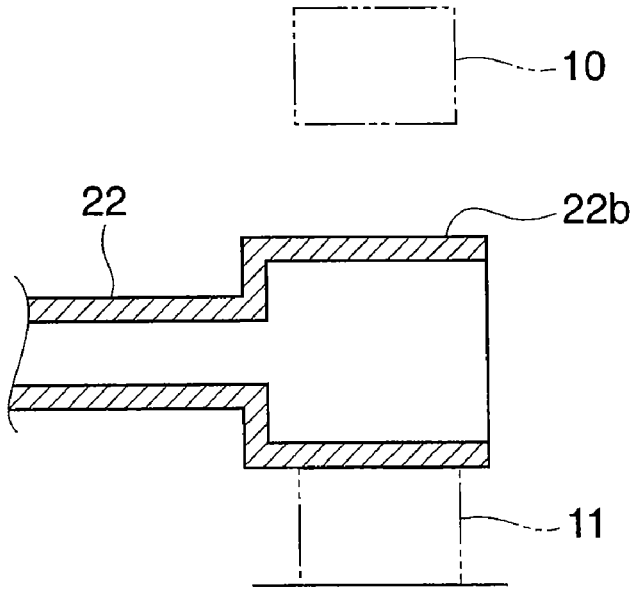
FIG. 8D is a section view showing a modification in which the non-fixed end of the pipe member is made large in outer size.

In an arrangement that the pipe member 22 has an outer cross-sectional shape which is circular, the non-fixed end 22*b* of the pipe member 22, in particular, those parts thereof adapted to be in contact with the upper and lower stopper 10, 11, may be made larger in outer dimension than the other part thereof, as shown in FIG. 8D, whereby the non-fixed end 22*b* is made large in area in which it is in contact with the upper and lower stoppers 10, 11, to prevent the stoppers 10, 11 from being subsided (deformed) during the long-term use. As a result, the buffer function and the key depression stroke can properly be maintained for the long term.

In the above described embodiments, the hammer base 21 is made of resin and the pipe member 22 is made of metal. Except for in the arrangement (see FIGS. 4A and 4B) adapted to positively introduce the portion 21*e*2 of resin into the fixed end 22*c* of the pipe member 22 to increase the holding strength of the pipe member 22, the hammer base 21 may not be made of resin but of metal such as magnesium, and the pipe member 22 may not be made of metal but of resin. The method of fixing the pipe member 22 to the hammer base 21 is not limited to outsert molding, but various fixing methods such as fitting, screwing or the like may be adopted.

The hammer 20 has a rear half thereof having a free end 22*a* for pivotal motion, but this is not limitative. This invention is also applicable to a construction in which the hammer base 21 and the pipe member 22 are reversed in longitudinal position and the free end 22*a* is provided in a front part of the hammer 20.

Sixth Embodiment

Figure 9:
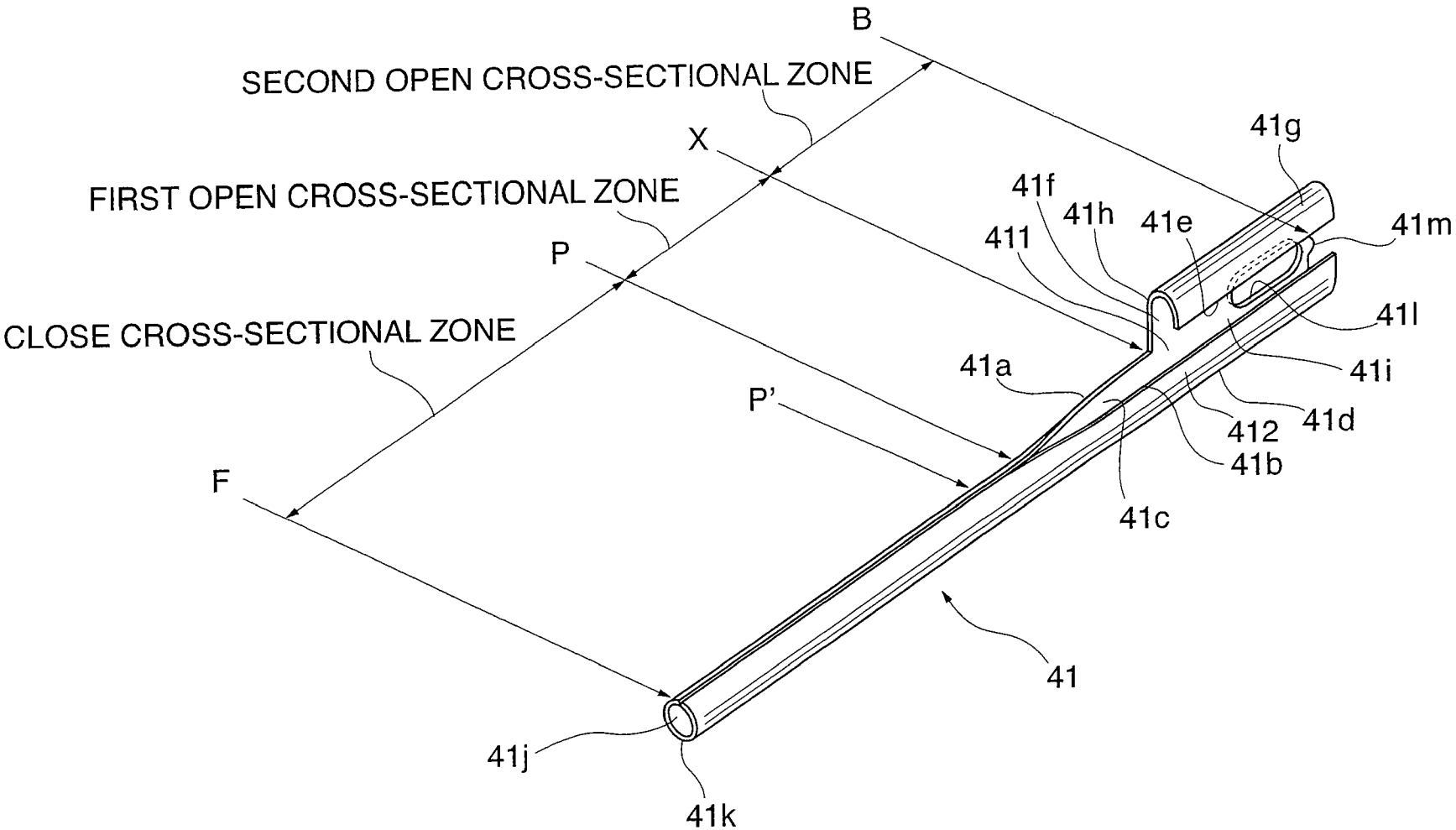
FIG. 9 is a perspective view showing a pipe-like member of a hammer in a keyboard apparatus according to a sixth embodiment of this invention.

FIG. 9 shows in a perspective view a pipe-like member of a hammer in a keyboard apparatus according to a sixth embodiment of this invention. In the first to fifth embodiments, the pipe-like member (pipe member 22) of the hammer 20 is formed by extrusion molding or drawing molding into a first type structure. On the other hand, the pipe-like member (elongated member 41) of the sixth embodiment is formed into a second type structure by bending a sheet metal into a tube, with left and right edges 41*a*, 41*b* of the sheet metal joined together.

The hammer of this embodiment is comprised of a hammer base and an elongated member 41. The hammer base is similar to the hammer base 21 of the first embodiment which has been explained with reference to FIGS. 1 to 2B. The elongated member 41 is made integral with the hammer base being outsert molded, with a front end F of the elongated member 41 inserted into a die, or by being inserted into a hole formed in the hammer base.

The elongated member 41 extends from its front end F to its rear end B in the longitudinal direction, and has a cross-sectional structure that varies along the longitudinal direction. In terms of the cross-sectional structure, the elongated member 41 is divided into a closed cross-sectional zone (F-P) extending from the front end F to a longitudinal position P, a first open cross-sectional zone (P-X) extending from the longitudinal position P to a longitudinal position X, and a second open cross-sectional zone (X-B) extending from the longitudinal position X to the rear end B. The cross-sectional structure of the elongated member 41 is different between these three zones.

For the closed cross-sectional zone (F-P), a thin sheet constituting the elongated member 41 is bent around a longitudinal axis using a solid core rod such that left and right edges of the sheet are joined together without or with a slight gap therebetween, thereby being formed into a hollow pipe having a closed cross section (in the illustrated example, a hollow cylindrical pipe having a completely closed cross section).

For the first open cross-sectional zone (P-X), the thin sheet constituting the elongated member 41 is bent such that the left and right edges 41*a*, 41*b* thereof are gradually spaced apart from each other toward the longitudinal position X to define a first opening 41*c* therebetween. On the side close to the longitudinal position X of the first open cross-sectional zone, the elongated member 41 is formed into a first structure of a hollow U-shaped cross-section comprised of left and right walls 411, 412 and a bottom wall 41*d*, which is open upward and has a hollow semi-circular cross section.

In the second open cross-sectional zone (X-B), the elongated member 41 includes a further structure in addition to the same structure as the first structure in the first open cross-sectional zone (P-X).

Specifically, in the second open cross-sectional zone (X-B), the elongated member 41 is comprised of a first partial structure formed by longitudinally extending the first structure in the first open cross-sectional zone (P-X) up to the rear end B, and a second partial structure of a hollow inverted U-shaped cross-section having left and right walls 411, 412 and a top wall 41*g* which is open downward and has a hollow semi-circular cross-section, wherein the first and second partial structures are coupled together through a left wall extension 41*h* vertically extending upward from the left wall 411 of the first partial structure. A second opening 41*f* is defined between the left and right walls of the second partial structure. The right wall of the second partial structure (second right wall) has a lower edge 41*e* thereof facing an upper edge 41*b* of the right wall of the first partial structure (first right wall). A third opening 41*i* is defined between the upper edge 41*b* of the first right wall and the lower edge 41*e* of the second right wall.

In the second open cross-sectional zone (X-B) of this embodiment, the elongated member 41 is formed by the first and second partial structures which are coupled together by the left wall extension 41*h*, and the third opening 41*i* is formed on the right-wall side of the first and second partial structures. However, instead of the left wall extension 41*h*, there may be formed a right wall extension extending from the right wall of the first partial structure and connecting the first and second partial structures together. In that case, the third opening is formed on the left-wall side of the first and second partial structures.

In the closed cross-sectional zone (F-P) of this embodiment, the elongated member 41 is formed to have a circular cross section. However, the elongated member 41 may be formed to have a rectangular cross section with four rounded corners. Furthermore, in the first open cross-sectional zone (P-X) of this embodiment, the elongated member 41 is formed into a U-shaped cross-sectional shape, but may be formed into a squared U-shaped or semi-circular cross-sectional shape.

As described above, in the second open cross-sectional zone (X-B), the first partial structure of the elongated member 41 has the bottom wall 41*d* of hollow semi-circular cross-section, and the second partial structure has the top wall 41*g* of hollow semi-circular cross-section. The bottom wall 41*d* is in contact at its lower surface with the lower limit stopper 11 of the keyboard chassis 4 (FIG. 1), and the top wall 41*g* is in contact at upper surface with the upper limit stopper 10 of the keyboard chassis 4. Since the bottom and top walls 41*d*, 41*g* of the elongated member 41 each have a rounded outer surface, the upper and lower limit stoppers 10, 11 made of felt, for example, can be prevented from being broken and can be improved in their durability.

As described above, in this embodiment, the elongated member 41 and the hammer base of the hammer 20 are made integral into one piece by outsert molding the hammer base, with the elongated member 41 obtained by bending a thin sheet metal being inserted into a mold. In a bending process of the thin sheet metal using a core rod of a circular cross-section, a tip end of the core rod is positioned on the thin sheet at a location corresponding to a longitudinal position P' on the elongated member 41, and then the thin sheet is formed to have a uniform hollow circular cross-section in a zone corresponding to a uniform cross-sectional zone (F-P') of the elongated member 41. In an integrally-molded zone of the elongated member 41, which is a part of or corresponds to the zone (F-P') or (F-P), the elongated member 41 is embedded in the hammer base by means of outsert molding. In this embodiment, the elongated member 41 is made integral with the hammer base, with its second partial structure directed upward. However, they can be made integral, with the second partial structure directed downward.

In connection with the above-described hammer fabrication method, the thin sheet has a lid portion 41*j* formed therein at a location forward of the front end F of the elongated member 41, so as to be integral with the elongated member 41 via coupling portion 41*k*. After the thin sheet is bent such that the elongated member 41 is formed into a hollow cylindrical shape as shown in FIG. 9, the lid portion 41*j* is bent at the coupling portion 41*k* at right angles relative to the elongated member 41, whereby the open front end F of the elongated member 41 is closed by the lid portion 41*j*.

Then, the hammer base is outsert-molded in a state that the open front end F of the elongated member 41 is closed by the lid portion 41*j*. As a result, during the outsert molding, molding pressure is applied to the elongated member 41 from all circumferential directions in the integrally-molded zone, whereby the quality of the hammer base is stabilized. In particular, since the elongated member 41 has a circular cross-section in its integrally-molded zone, the molding pressure applied to the elongated member 41 is made uniform in all the circumferential directions, contributing to the hammer base having stable quality.

Since the hammer base is outsert-molded in a condition that the open front end F of the elongated member 41 is closed by the lid portion 41*j*, resin is prevented or suppressed from flowing into the elongated member 41, whereby the resin is prevented from flowing to the outside of the mold through the hollow of the elongated member 41. Instead of the lid portion 41*j*, some obstacle for preventing or regulating the flow of resin may be disposed inside the elongated member 41. The intrusion of resin into the interior of the elongated member 41 does not cause per se a substantial problem, however, when an amount of intrusion of resin is not constant, the weight and the moment of inertia vary between individual elongated members 41 and hence between individual hammers, which is disadvantageous.

The elongated member 41 is heavier in the second open cross-sectional zone (X-B) by the weight of the second partial structure and the left wall extension 41*h* than in the closed cross-sectional zone (F-P) and the first open cross-sectional zone (P-X). In other words, a mass concentration portion is formed by the second open cross-sectional zone (X-B). With this embodiment, therefore, the mass concentration portion can be formed by simply bending a thin sheet metal. The rear end B of the elongated member 41 is a free end. Instead of the second open cross-sectional zone (X-B) of the elongated member 41, a separate mass concentration portion may be provided.

Since the moment of inertia is proportional to the mass and the square of the radius of rotation, the moment of inertia or the inertia mass can be increased by forming the second open cross-sectional zone (X-B) of the elongated member 41 into the mass concentration portion.

In this embodiment, the elongated member 41 in the second open cross-sectional zone (X-B) is comprised of the first and second partial structures which are coupled together by the left wall extension 41*h*. However, the first and second partial structures may be coupled by a right wall extension extending from the right wall of the first partial structure. Alternatively, the left wall extension 41*h* and the right wall extension may be formed integrally with the left and right walls of the first partial structure, respectively, and the first and second partial structures may be coupled together through one of these extensions. In that case, another extension may be disposed such that an upper edge thereof faces or is joined to a lower edge of the left or right wall of the second partial structure.

In this embodiment, the elongated member 41 includes the closed cross-sectional zone (F-P). However, the closed cross-sectional zone may be eliminated, so that the elongated member 41 only includes the first and second open cross-sectional zones (F-X), (X-B). Furthermore, the closed and first open cross-sectional zones may be eliminated, so that the elongated member 41 only includes the second open cross-sectional zone.

As shown in FIG. 9, in the second open cross-sectional zone (X-B), a through hole 41*l* is formed in the left wall of the elongated member 41 (the left wall extension 41*h* and left walls of the first and second partial structures) at a location near the rear end B, and a small projection 41*m* is formed in the rear end B.

It is not inevitably necessary to form the through hole 41*l* and the small projection 41*m* in the elongated member 41, however, they are useful for adjusting the mass of the elongated member 41 and for positioning the hammer base being outsert-molded. The through hole 41*l* can be used for holding and transporting the elongated member 41 in a plating apparatus or in an automatic parts transport system. Furthermore, by fitting a filler into the through hole 41*l*, a variation in the key touch weight or the moment of inertia can be provided. Such a filler can also be utilized for key-touch scaling.

In a keyboard apparatus having a key-touch scaling mechanism, there are used many variations of the elongated member 41. The key-touch scaling is achieved by making a difference in the moment of inertia between respective hammers according to the pitch or pitch range assigned to keys corresponding to these hammers. For example, hammers for higher pitch keys are made lighter in weight. As a result, lower-pitch keys can be operated with heavy key touch and higher-pitch keys can be operated with light key touch. To this end, for example, the longitudinal position X on the elongated member 41 corresponding to the boundary between the first and second open cross-sectional zones is set toward the rear end B for higher-pitch keys, to thereby reduce the length of the mass concentration portion. Alternatively, for higher-pitch keys, the longitudinal length of the elongated member 41 is made short in addition to or instead of decreasing the length of the mass concentration portion.

In the keyboard apparatus having the key-touch scaling mechanism, the size and/or position of the through hole 41*l* and/or the small projection 41*m* can be varied according to elongated member variations for production management such as automatically recognizing or selecting the elongated member 41 variations.

What is claimed is:

1. A keyboard apparatus for an electronic musical instrument, comprising:

a frame;

at least one key having a hammer-actuating portion and supported for pivotal motion on said frame; and at least one hammer disposed to correspond to said key and having a pivotal fulcrum and an actuated portion, said hammer being supported on said frame such as to be pivoted about the pivotal fulcrum when the actuated portion thereof is actuated by the hammer-actuating portion of said key, said hammer being adapted to impart, when pivoted, inertia to an operation of depressing the key, wherein said hammer includes a hammer base thereof provided with the pivotal fulcrum and the actuated portion, and an extension thereof fabricated separately from the hammer base and provided to extend from the hammer base, said extension being formed by a pipe-like member having one end thereof fixed to the hammer base.

2. A keyboard apparatus for an electronic musical instrument according to claim 1, wherein at least the one end of the pipe-like member of said hammer is formed to have an outer cross-sectional shape which is not a circular shape.

3. A keyboard apparatus for an electronic musical instrument according to claim 1, wherein the pipe-like member has a modified cross-sectional portion smaller in inner cross-section than a uniform cross-sectional portion of the pipe-like member.

4. A keyboard apparatus for an electronic musical instrument according to claim 1, wherein a plug for closing an opening in the one end of the pipe-like member is provided at the one end of the pipe-like member.

5. A keyboard apparatus for an electronic musical instrument according to claim 1, wherein a plug for closing an opening in another end of the pipe-like member is provided at the other end of the pipe-like member.

6. A keyboard apparatus for an electronic musical instrument according to claim 4, wherein the plug is a screw.

7. A keyboard apparatus for an electronic musical instrument according to claim 5, wherein the plug is a screw.

8. A keyboard apparatus for an electronic musical instrument according to claim 1, wherein the hammer base is formed integrally from resin, and the resin surrounds an outside of the one end of the pipe-like member and intrudes into inside the pipe-like member through an opening at the one end thereof.

9. A keyboard apparatus for an electronic musical instrument according to claim 1, wherein a plurality of said hammers are provided to correspond to respective ones of a plurality of said keys, the pipe-like member of each of said hammers has, at another end thereof, a mass member fabricated separately from the pipe-like member, and key scaling of a key depression feeling is achieved by making a difference between said plurality of said hammers in at least one of a longitudinal position at which the mass member is disposed and density, shape, and volume of the mass member.

10. A keyboard apparatus for an electronic musical instrument according to claim 1, wherein the pipe-like member of said hammer is formed by a pipe member.

* * * * *

UNITED STATES PATENT AND TRADEMARK OFFICE

CERTIFICATE OF CORRECTION

PATENT NO. : 7,767,892 B2
APPLICATION NO. : 12/051573
DATED : August 3, 2010
INVENTOR(S) : Ichiro Osuga It is certified that error appears in the above-identified patent and that said Letters Patent is hereby corrected as shown below:

The Title page of the patent should include:

-- (30) Foreign Application Priority Data

March 26, 2007 (JP) .....2007-079111 --

Signed and Sealed this
Twenty-second Day of February, 2011

David J. Kappos

David J. Kappos
*Director of the United States Patent and Trademark Office*